United States Patent [19]

Konishi et al.

[11] 4,060,982

[45] Dec. 6, 1977

[54] EXHAUST GAS PURIFIER FOR AN INTERNAL COMBUSTION ENGINE

[75] Inventors: Masami Konishi; Kazumasa Futamura, both of Toyota, Japan

[73] Assignee: Toyota Jidosha Kogyo Kabushiki Kaisha, Toyota, Japan

[21] Appl. No.: 670,009

[22] Filed: Mar. 24, 1976

[30] Foreign Application Priority Data

Dec. 17, 1975 Japan ..... 50-149472

[51] Int. Cl.[2] ..... F01N 3/10

[52] U.S. Cl. ..... 60/282; 60/323; 113/116 W; 228/165

[58] Field of Search ..... 60/282, 322, 323; 113/116 W; 228/165, 257

[56] References Cited

U.S. PATENT DOCUMENTS

| | | | |
|---|---|---|---|
| 1,760,955 | 6/1930 | Moss | 113/116 W |
| 3,095,644 | 7/1963 | Curry | 228/165 |
| 3,633,368 | 1/1972 | Rosenlund | 60/282 |
| 3,722,221 | 3/1973 | Chopin | 60/282 |

*Primary Examiner*—Douglas Hart

*Attorney, Agent, or Firm*—Stevens, Davis, Miller & Mosher

[57] ABSTRACT

An exhaust gas purifier for an internal combustion engine comprises a chamber therein for burning unburned gas in the exhaust gas from the engine and an inlet port liner for leading the exhaust gas from the engine cylinder into said chamber. The inlet port liner is rigidly fixed to the housing of the purifier by means of weld metal which is poured onto the outer surface of the inlet port liner through a hole formed on the housing of the purifier.

4 Claims, 5 Drawing Figures

EXHAUST GAS PURIFIER FOR AN INTERNAL COMBUSTION ENGINE

DESCRIPTION OF THE INVENTION

The present invention relates to an exhaust gas purifier for an internal combustion engine, and particularly relates to an exhaust gas purifier in which the inlet port liner mounted on the inside of the reactor housing forms an exhaust gas passage which communicates the exhaust port outlet opening of the cylinder head with the chamber in the reactor for burning unburned gas in the exhaust gas (hereinafter referred to as a reburning chamber).

At present, a majority of the internal combustion engines is provided with exhaust gas purifiers which use reactors for cleaning the exhaust gas by oxidizing the exhaust gas from the engine in order to eliminate harmful components in the exhaust gas, for example unburned gases HC and CO. FIGS. 1 and 2 show a typical conventional exhaust gas purifier. Referring to FIGS. 1 and 2, the exhaust gas purifier 10 is made of cast metal and comprises the reactor housing body 11 comprised of the housing 11*a* and housing 11*b*, the outer core 12 disposed in the reactor housing body 11 and fixed to the housing body 11 by means of a suitable manner of attachment (not shown), the inner core 13 disposed in the outer core 12 and fixed to the outer core 12 by means of the support member 14, and the inlet port liner 16 disposed inside of the housing 11*b*, one end of the inlet port liner 16 extending into the inside of the reburning chamber 15 in the inner core 13. The housing body 11 is fixed onto the cylinder head 20 though the gasket 19 by means of bolts (not shown) so as to align the exhaust port 17 of the cylinder head 20 with the inlet port 18 in the reactor. The gap between the outer core 12 and the housing body 11 is filled with the heat insulation material 21 in order to retain the heat in the reburning chamber 15 and the reburning chamber 27 formed between the inner core 13 and the outer core 12. The inlet port liner 16 has a flange 22 at its one end, and the periphery of the flange 22 is fitted into an annular groove 23 formed on the inside wall of the housing 11*b*. The inlet port liner 16 passes through the circular hole 24 formed in the housing 11*a*. The exhaust gas seal collar 25 is fitted onto the inlet port liner 16 in a manner such that the inner surface of the seal collar 25 is in contact with the outer surface of the inlet port liner 16. The outer core 12 is fitted into the outer peripheral groove 26 of the seal collar 25. When the engine is started, heat of the exhaust gas causes thermal expansions of the inlet port liner 16 and the outer core 12. Consequently, the flange 22 of the inlet port liner 16 is loosely fitted into the annular groove 23 with play, on one hand; and the outer core 12 is loosely fitted into the outer peripheral groove 26 of the seal collar 25 with play, on the other hand.

The exhaust gas from the engine cylinders is delivered into the inlet port 18 via the exhaust port 17 and then is delivered into the reburning chamber 15. Although the oxidation of the exhaust gas is started in the exhaust port 17, the majority of the exhaust gas is oxidized in the reburning chamber 15 and 27. As is known to the general public, in order to promote the oxidation of the exhaust gas, it is preferable that the temperature of the exhaust gas is as high as possible. Consequently, the gap 28 functioning as a heat insulator is formed between the inlet port liner 16 and the inner wall of the housing 11*b* in order to maintain the exhaust gas from the engine at a high temperature. In the embodiment shown in FIG. 2, the gap 28 is filled with the heat insulation material. This heat insulation material prevents the inlet port liner from resonating under the vibration of the engine by the cushioning characteristics of the heat insulation material.

The exhaust gas delivered to the reburning chamber 15 from the engine flows in the direction of arrow A (see FIG. 1), and then flows into the reburning chamber 27 formed between the outer core 12 and the inner core 13 via the opposite end openings of the inner core 13. Then the exhaust gas thus cleaned is delivered to the atmosphere via the outlet port 29 of the exhaust gas purifier 10 and the exhaust pipe 30.

The exhaust gas purifier of the above construction has the following drawbacks. As it is apparent from FIG. 2, the inlet port liner 16 is supported at its flange 22 by the annular groove 23 and also is supported at the central portion thereof by the circular hole 24. As is mentioned above, by taking into consideration the thermal expansion, the flange 22 is loosely fitted into the annular groove 23 with play. Consequently, when the engine is operated, the heat insulation material is gradually sucked out from the gap between the flange 22 and the annular groove 23 into the exhaust gas, and thus the cushioning ability of the thermal insulation material is gradually reduced. Consequently the engine vibration causes the inlet port liner 16 to vibrate relative to the housing body 11. This results in causing a gas leakage from the contact surfaces of the exhaust gas seal collar 25 and of the inlet port liner 16 whereby sometimes causing the deformation of the outer core 12 and the dissipation of the heat insulation material 21.

An exhaust gas purifier comprised of sheet metal has already been proposed as shown in FIG. 3. Referring to FIG. 3, the exhaust gas purifier has a similar construction to that of the purifier shown in FIG. 2 and comprises the outer core 12', the inner core 13', the inlet port liner 16' and the exhaust gas seal collar 25' fitted into the outer periphery of the inlet port liner 16'. The housing body 11' comprises the housing 11'*a*, the housing 11'*b* and the flange 11'*c*, each of which is made from a sheet metal and is welded to each other. In the exhaust gas purifier shown in FIG. 3, the inlet port liner 16' is welded at its one end to the housing body 11' as shown in B, and then the welded portion B is ground so as to have a flat surface. In the exhaust gas purifier manufactured in the above-mentioned manner, it is true that the inlet port liner 16 can be prevented from vibrating relative to the housing body 11' because the inlet port liner 16' is rigidly fixed to the housing body 11'. However, there is a need for further machine operation after the welding operation. If the welded portion is not ground to a completely flat surface, then there is a danger of creating a gas leakage between the welded portion and the gasket when the exhaust gas purifier is attached to the cylinder head as shown in FIG. 2. Furthermore, when the housing body 11' is made of cast metal, a particular welding technique is required. When a welding operation is effected, there is a danger of causing distortion in the cast metal, thereby causing cracks in the cast metal.

An object of the present invention is to eliminate the above-mentioned drawbacks and to provide an exhaust gas purifier having an inlet port liner which is rigidly fixed to the housing in an extremely simple manner.

Another object of the present invention is to provide a method for assembling a purifier.

According to the present invention, an exhaust gas purifier of an internal combustion engine, comprises a housing, a chamber in said housing for burning unburned gas in the exhaust gas from the engine, an inlet port liner in said housing, said inlet port liner forming an exhaust gas passage which communicates said chamber and the exhaust gas outlet opening of the cylinder head of the engine for leading the exhaust gas from the engine cylinder into said chamber, and an outlet port for leading the exhaust gas in said chamber to the atmosphere, and furthermore, said housing has at least one through-hole for pouring melted weld metal towards the outer peripheral surface of the inlet port liner from the outside of the housing so that the weld metal is disposed in said through-hole for rigidly connecting the inlet port liner with the housing.

Furthermore, according to the present invention, a method for assembling an exhaust gas purifier of an internal combustion engine, comprises the steps of:

boring at least one hole through the housing wall;
inserting the inlet port liner into the housing, and;
pouring melted weld metal into said through-hole towards the outer peripheral surface of the inlet port liner so that, when said weld metal solidifies, an enlarged portion having a larger diameter than that of said through-hole is formed at the outer end of the soldified weld metal.

The above-mentioned object of the present invention may be more fully understood from the following descriptions of a preferred embodiment of the invention, together with the accompanying drawings.

DESCRIPTION OF A PREFERRED EMBODIMENT

Figure 1:
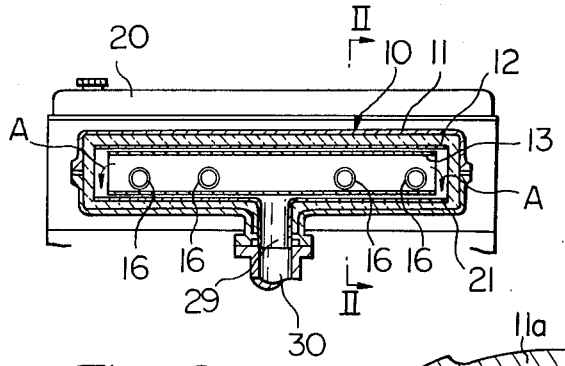
Fig. 1 (PRIOR ART)
FIG. 1 is a side elevational cross-sectional view, of a conventional exhaust gas purifier.
Figure 2:
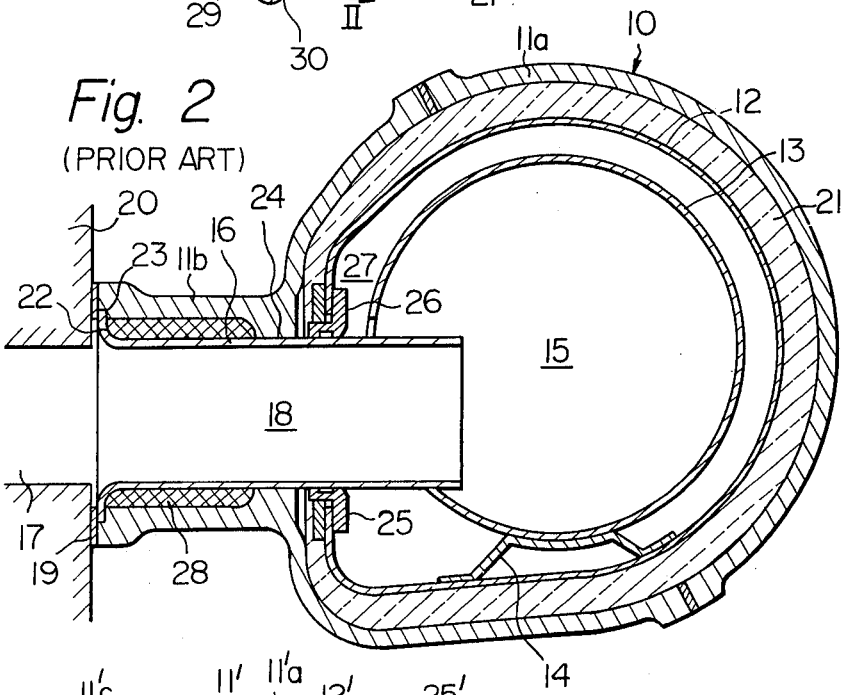
Fig. 2 (PRIOR ART)
FIG. 2 is a cross-sectional view taken along the line II—II in FIG. 1.
Figure 3:
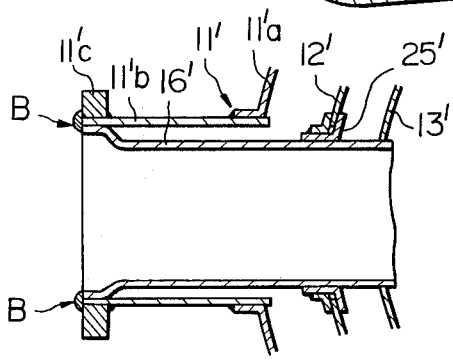
Fig. 3 (PRIOR ART)
FIG. 3 is a side elevational cross-sectional view of a part of another conventional exhaust gas purifier.
Figure 4:
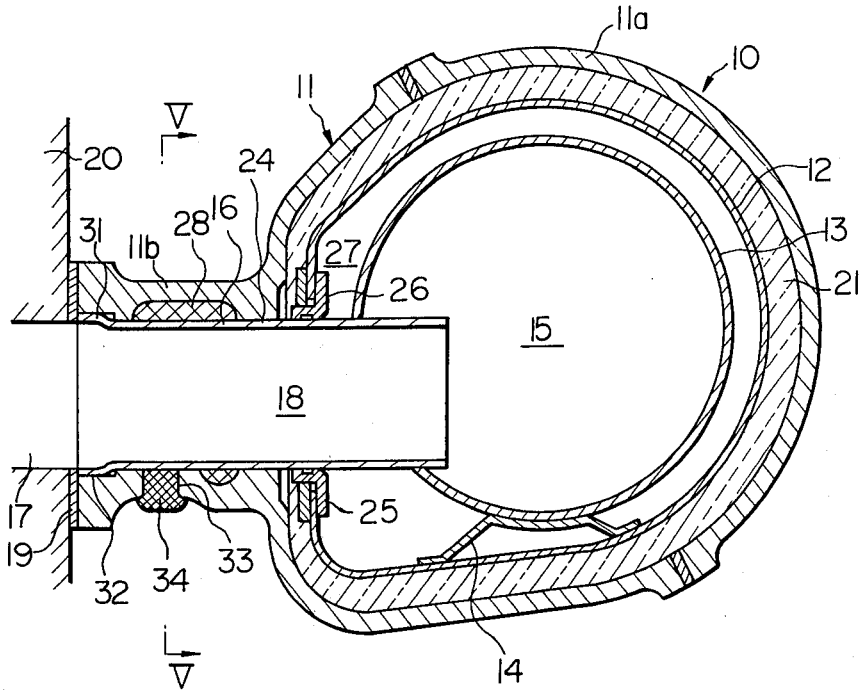
FIG. 4 is a side elevational cross-sectional view, of an exhaust gas purifier according to the present invention.
Figure 5:
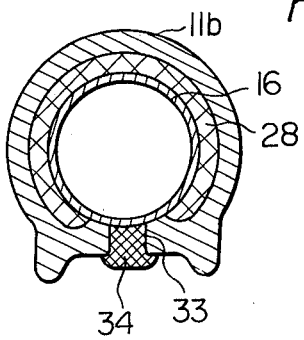
FIG. 5 is a cross-sectional view taken along the line V—V in FIG. 4.

FIG. 4 shows an exhaust gas purifier according to the present invention and FIG. 5 shows a cross-sectional view taken along the line V—V in FIG. 4. In FIG. 4, similar components are indicated with the same reference numerals in FIG. 2. Referring to FIGS. 4 and 5, an inlet port liner 16 has at its one end an increased diameter portion 31, and said increased diameter portion 31 is press-fitted into an annular groove 32 formed on the inner wall of the housing **11*b*. A through-hole 33 is formed in the housing 11*b*, and the melted weld metal is poured into the through-hole 33 towards the outer peripheral surface of the inlet port liner 16. The poured weld metal is welded onto the outer peripheral surface of the inlet port liner 16; however, this poured weld metal does not need to be welded onto the housing body 11 which is made of cast metal. As indicated by reference numeral 34, the outer end of the solidified weld metal is enlarged and thus the solidified weld metal has a rivet-like shape. Consequently, the inlet port liner 16 is rigidly fixed to the housing body 11 by means of the rivet-like shaped weld metal. This means of attachment can be applied to the purifier of the type without the gap 28 and also applied to the purifier having the housing body 11 made of sheet metal. Furthermore, the gap 28** may be filled with a heat insulation material.

According to the present invention, the inlet port liner is rigidly fixed to the housing body in an extremely simple manner. Thus, there is no danger of causing a gas leakage from the contact surfaces of the exhaust gas seal collar and of the outer wall of the inlet port liner because the inlet port liner does not vibrate relative to the housing body. In addition, since the end of the inlet port liner is press-fitted into the housing body and the inlet port liner does not vibrate relative to the housing body, the heat insulation material contained in gap 28 is not sucked out into the exhaust gas.

What is claimed is:

1. An exhaust gas purifier for an internal combustion engine, comprising:

a housing;
a chamber in said housing for burning unburned gas in the exhaust gas from the engine;
an inlet port liner in said housing, said inlet port liner forming an exhaust gas passage which communicates said chamber and the exhaust gas outlet opening of the cylinder head of the engine for leading the exhaust gas from the engine cylinder into said chamber, and;
an outlet port for leading the exhaust gas in said chamber to the atmosphere;

wherein the outer end of the inlet port liner is press-fitted into a portion of the inner wall of the housing adjacent one end thereof and there is an annular gap between the liner and the housing and said housing has at least one through-hole for pouring melted weld metal towards the outer peripheral surface of the inlet port liner from the outside of the housing and a weld metal is disposed in said through-hole for rigidly connecting the inlet port liner with the housing.

2. An exhaust gas purifier as recited in claim 1, said weld metal has at its outer end an enlarged portion to clamp the inlet port liner onto the housing.

3. The purifier of claim 1 including a shoulder in said annular gap in which said at least one through-hole is located.

4. A method for assembling an exhaust gas purifier of an internal combustion engine, said purifier comprising:

a housing;
a chamber in said housing for burning unburned gas in the exhaust gas from the engine;
an inlet port liner in said housing, said inlet port liner forming an exhaust gas passage which communicates said chamber and the exhaust gas outlet opening of the cylinder head of the engine for leading the exhaust gas from the engine cylinder into said chamber, and;
an outlet port for leading the exhaust gas in said chamber to the atmosphere; said method comprising the steps of:
boring at least one hole through the housing wall;
inserting the inlet port liner into the housing and press-fitting the outer end of the liner into a portion of the housing adjacent one end thereof, and;
pouring melted weld metal into said through-hole towards the outer peripheral surface of the inlet port liner so that, when said weld metal solidifies, an enlarged portion having a larger diameter than that of said through-hole is formed at the outer end of solidified weld metal.

* * * * *